US009920468B2

(12) United States Patent
Hendrickson et al.

(10) Patent No.: US 9,920,468 B2
(45) Date of Patent: Mar. 20, 2018

(54) HOUSEHOLD CLEANING APPLIANCE WITH A NON-BULK DISPENSING SYSTEM CONVERTIBLE TO A HOUSEHOLD CLEANING APPLIANCE WITH A BULK DISPENSING SYSTEM

(71) Applicant: WHIRLPOOL CORPORATION, Benton Harbor, MI (US)

(72) Inventors: Michael S. Hendrickson, Stevensville, MI (US); Joel A. Luckman, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 345 days.

(21) Appl. No.: 14/697,947

(22) Filed: Apr. 28, 2015

(65) Prior Publication Data

US 2015/0240407 A1 Aug. 27, 2015

Related U.S. Application Data

(62) Division of application No. 12/165,726, filed on Jul. 1, 2008, now abandoned.

(51) Int. Cl.
*D06F 39/02* (2006.01)
*D06F 33/02* (2006.01)

(52) U.S. Cl.
CPC ..... *D06F 39/022* (2013.01); *D06F 33/02* (2013.01); *D06F 39/028* (2013.01); *Y10T 29/49716* (2015.01)

(58) Field of Classification Search
CPC ..... D06F 39/022; D06F 39/02; D06F 39/028
See application file for complete search history.

(56) References Cited

U.S. PATENT DOCUMENTS

| | | | |
|---|---|---|---|
| 2,816,427 | A | 12/1957 | Vela |
| 2,872,076 | A | 2/1959 | Bloom |
| 3,120,329 | A | 2/1964 | Noakes |
| 3,736,773 | A | 6/1973 | Waugh |
| 3,826,408 | A | 7/1974 | Berndt et al. |
| 3,848,436 | A | 11/1974 | Rottering |
| 3,848,437 | A | 11/1974 | Rottering |
| 3,850,185 | A | 11/1974 | Guth |
| 3,881,328 | A | 5/1975 | Kleimola et al. |
| 3,990,272 | A | 11/1976 | Gakhar |
| 4,009,598 | A | 3/1977 | Bernard et al. |
| 4,103,520 | A | 8/1978 | Jarvis et al. |

(Continued)

FOREIGN PATENT DOCUMENTS

| | | | |
|---|---|---|---|
| CA | 2027154 | A1 | 4/1991 |
| DE | 8033429 | U1 | 5/1982 |

(Continued)

OTHER PUBLICATIONS

Machine translation of JP 11-309296 A, no date.*

(Continued)

*Primary Examiner* — Joseph L Perrin

(57) ABSTRACT

A household cleaning appliance having a treating chamber and a non-bulk dispensing system coupled with the treating chamber and having a portion of material configured to be removable wherein the non-bulk dispensing system is configured to receive a removable cartridge containing a treating chemistry when such material is removed.

19 Claims, 6 Drawing Sheets

(56) References Cited

U.S. PATENT DOCUMENTS

| | | | |
|---|---|---|---|
| 4,162,028 | A | 7/1979 | Reichenberger |
| 4,426,362 | A | 1/1984 | Copeland et al. |
| 4,569,781 | A | 2/1986 | Fernholz et al. |
| 4,580,721 | A | 4/1986 | Coffee et al. |
| 4,763,493 | A | 8/1988 | Nishite et al. |
| 4,763,494 | A | 8/1988 | der Kinderen |
| 4,790,981 | A | 12/1988 | Mayer et al. |
| 4,845,965 | A | 7/1989 | Copeland et al. |
| 4,862,711 | A | 9/1989 | Ikeda et al. |
| 4,875,607 | A | 10/1989 | Torita et al. |
| 5,014,211 | A | 5/1991 | Turner et al. |
| 5,063,757 | A | 11/1991 | Ikeda et al. |
| 5,088,621 | A | 2/1992 | Thompson et al. |
| 5,134,867 | A | 8/1992 | Kiuchi et al. |
| 5,186,912 | A | 2/1993 | Steindorf et al. |
| 5,195,338 | A | 3/1993 | Russo |
| 5,207,080 | A | 5/1993 | Reinhard |
| 5,234,615 | A | 8/1993 | Gladfelter et al. |
| 5,316,688 | A | 5/1994 | Gladfelter et al. |
| 5,390,385 | A | 2/1995 | Beldham |
| 5,392,827 | A | 2/1995 | Yasso et al. |
| 5,417,233 | A | 5/1995 | Thomas et al. |
| 5,435,157 | A | 7/1995 | Laughlin |
| 5,606,877 | A | 3/1997 | Hashimoto |
| 5,636,763 | A | 6/1997 | Furness |
| 5,743,115 | A | 4/1998 | Hashimoto |
| 5,758,521 | A | 6/1998 | Roberts |
| 5,836,482 | A | 11/1998 | Ophardt et al. |
| 5,839,097 | A | 11/1998 | Klausner |
| 5,870,906 | A | 2/1999 | Denisar |
| 5,897,671 | A | 4/1999 | Newman et al. |
| 5,913,454 | A | 6/1999 | McHale |
| 5,992,685 | A | 11/1999 | Credle, Jr. |
| 6,007,788 | A | 12/1999 | Bellon et al. |
| 6,169,964 | B1 | 1/2001 | Aisa et al. |
| 6,227,012 | B1 | 5/2001 | Borroni et al. |
| 6,349,440 | B1 | 2/2002 | Amberg et al. |
| 6,401,499 | B1 | 6/2002 | Clark et al. |
| 6,434,977 | B1 | 8/2002 | Hapke et al. |
| 6,918,398 | B2 | 7/2005 | Edelmann et al. |
| 6,995,129 | B2 | 2/2006 | Olson et al. |
| 6,998,380 | B2 | 2/2006 | Fry et al. |
| 7,036,175 | B2 | 5/2006 | Sears et al. |
| 7,047,663 | B2 | 5/2006 | Zhang et al. |
| 7,059,065 | B2 | 6/2006 | Gerlach et al. |
| 7,066,412 | B2 | 6/2006 | Conley et al. |
| 7,177,712 | B2 | 2/2007 | Blair et al. |
| 7,250,086 | B2 | 7/2007 | Furber et al. |
| 7,275,552 | B2 | 10/2007 | DeWeerd et al. |
| 7,424,813 | B2 | 9/2008 | Wu |
| 7,464,718 | B2 | 12/2008 | McIntyre et al. |
| 7,578,150 | B2 | 8/2009 | Zsambeki |
| 7,658,088 | B2 | 2/2010 | Walker et al. |
| 7,725,970 | B2 | 6/2010 | Tuttle et al. |
| 7,950,088 | B2 | 5/2011 | Dalton et al. |
| 8,052,805 | B2 | 11/2011 | Hendrickson et al. |
| 8,122,743 | B2 | 2/2012 | Schulze |
| 8,196,441 | B2 | 6/2012 | Hendrickson et al. |
| 8,246,756 | B2 | 8/2012 | Hendrickson et al. |
| 8,382,913 | B2 | 2/2013 | Classen et al. |
| 8,397,544 | B2 | 3/2013 | Hendrickson |
| 8,438,881 | B2 | 5/2013 | Ihne et al. |
| 8,468,858 | B2 | 6/2013 | Hendrickson et al. |
| 8,505,341 | B2 | 8/2013 | Hendrickson et al. |
| 8,677,538 | B2 | 3/2014 | Hendrickson et al. |
| 8,713,737 | B2 | 5/2014 | Ihne et al. |
| 8,789,226 | B2 | 7/2014 | Dalton et al. |
| 9,074,312 | B2 | 7/2015 | D'Andrea et al. |
| 2001/0049846 | A1 | 12/2001 | Guzzi et al. |
| 2002/0040505 | A1 | 4/2002 | Tanaka et al. |
| 2002/0040506 | A1 | 4/2002 | Seagar et al. |
| 2002/0088502 | A1 | 7/2002 | Van Rompouy |
| 2003/0009428 | A1 | 1/2003 | Barbe |
| 2003/0010791 | A1 | 1/2003 | Gentiluomo et al. |
| 2003/0051513 | A1 | 3/2003 | Castelli et al. |
| 2003/0116177 | A1 | 6/2003 | Appel et al. |
| 2003/0154560 | A1 | 8/2003 | Behrens et al. |
| 2003/0213503 | A1 | 11/2003 | Price et al. |
| 2003/0233168 | A1 | 12/2003 | Perin, Jr. et al. |
| 2003/0233710 | A1 | 12/2003 | Classen |
| 2004/0005990 | A1 | 1/2004 | Aubay et al. |
| 2004/0010859 | A1 | 1/2004 | Aubay et al. |
| 2004/0082491 | A1 | 4/2004 | Olson et al. |
| 2004/0084065 | A1 | 5/2004 | Edelmann et al. |
| 2004/0098811 | A1 | 5/2004 | Tuttle et al. |
| 2004/0244434 | A1 | 12/2004 | Zucholl et al. |
| 2004/0244819 | A1 | 12/2004 | Edelmann et al. |
| 2005/0121058 | A1 | 6/2005 | Furber et al. |
| 2005/0126608 | A1 | 6/2005 | DeWeerd et al. |
| 2005/0229652 | A1 | 10/2005 | Kim et al. |
| 2006/0040845 | A1 | 2/2006 | Gladfelter et al. |
| 2006/0107705 | A1 | 5/2006 | Hsu et al. |
| 2006/0117811 | A1 | 6/2006 | Kinnetz |
| 2006/0150437 | A1 | 7/2006 | Tarnowski et al. |
| 2006/0196529 | A1 | 9/2006 | Kenowski et al. |
| 2006/0254626 | A1 | 11/2006 | Botts et al. |
| 2006/0270579 | A1 | 11/2006 | Aubay et al. |
| 2006/0272359 | A1 | 12/2006 | Kang |
| 2006/0272360 | A1 | 12/2006 | Hsu et al. |
| 2007/0022790 | A1 | 2/2007 | Slutsky et al. |
| 2007/0084253 | A1 | 4/2007 | Ehrlich et al. |
| 2007/0131000 | A1 | 6/2007 | Jeong |
| 2007/0163098 | A1 | 7/2007 | Tomasi et al. |
| 2007/0163307 | A1 | 7/2007 | Kramme et al. |
| 2007/0261177 | A1 | 11/2007 | Risen et al. |
| 2008/0107576 | A1 | 5/2008 | Zettlitzer et al. |
| 2008/0276966 | A1 | 11/2008 | Yusuf et al. |
| 2009/0095028 | A1 | 4/2009 | Hoppe et al. |
| 2009/0095031 | A1 | 4/2009 | Favaro et al. |
| 2009/0100880 | A1 | 4/2009 | Hill |
| 2009/0100881 | A1 | 4/2009 | Dahlke |
| 2009/0158782 | A1 | 6/2009 | Hill |
| 2009/0235962 | A1 | 9/2009 | Classen et al. |
| 2009/0293202 | A1 | 12/2009 | Bolduan et al. |
| 2009/0308111 | A1 | 12/2009 | Robb et al. |
| 2010/0000264 | A1 | 1/2010 | Luckman et al. |
| 2010/0000580 | A1 | 1/2010 | Classen et al. |
| 2010/0040213 | A1 | 2/2010 | Park et al. |
| 2010/0115708 | A1 | 5/2010 | Caswell et al. |
| 2010/0300157 | A1 | 12/2010 | Schulze |
| 2011/0017239 | A1 | 1/2011 | VanLoyen et al. |

FOREIGN PATENT DOCUMENTS

| | | | |
|---|---|---|---|
| DE | 3403622 | A1 | 8/1985 |
| DE | 3403852 | A1 | 8/1985 |
| DE | 3833961 | A1 | 4/1990 |
| DE | 3908438 | A1 | 9/1990 |
| DE | 4014776 | A1 | 11/1991 |
| DE | 4017001 | A1 | 11/1991 |
| DE | 69019666 | T2 | 10/1995 |
| DE | 19619602 | A1 | 11/1997 |
| DE | 19902974 | A1 | 10/1999 |
| DE | 20115173 | U1 | 11/2001 |
| DE | 10144667 | A1 | 3/2003 |
| DE | 10334283 | A1 | 12/2004 |
| DE | 102006043913 | A1 | 3/2008 |
| DE | 102007023065 | A1 | 11/2008 |
| DE | 102009030288 | A1 | 1/2010 |
| DE | 102009030290 | A1 | 1/2010 |
| DE | 102009030329 | A1 | 1/2010 |
| EP | 0169604 | A2 | 1/1986 |
| EP | 423044 | A1 | 4/1991 |
| EP | 0611159 | A1 | 8/1994 |
| EP | 0685587 | A1 | 12/1995 |
| EP | 1063340 | A1 | 12/2000 |
| EP | 1637060 | A2 | 3/2006 |
| EP | 1731654 | A1 | 12/2006 |
| EP | 1808520 | A1 | 7/2007 |
| EP | 1842953 | A2 | 10/2007 |
| EP | 1849909 | A1 | 10/2007 |
| EP | 1884584 | A2 | 2/2008 |
| EP | 2003237 | A1 | 12/2008 |
| EP | 2141276 | A1 | 1/2010 |

(56) References Cited

FOREIGN PATENT DOCUMENTS

| | | | | |
|---|---|---|---|---|
| EP | 2324151 | B1 | | 12/2011 |
| EP | 2518204 | A1 | | 10/2012 |
| EP | 2342377 | B1 | | 1/2015 |
| GB | 2015870 | A | | 9/1979 |
| GB | 2134078 | A | | 8/1984 |
| GB | 2136831 | A | | 9/1984 |
| GB | 2214524 | A | | 9/1989 |
| GB | 2311767 | A | | 10/1997 |
| GB | 2386130 | A | | 9/2003 |
| GB | 2417492 | A | | 3/2006 |
| IT | TO20060569 | A1 | | 2/2008 |
| JP | 03191994 | A | | 8/1991 |
| JP | 11309296 | A | * | 11/1999 |
| WO | 8806199 | A1 | | 8/1988 |
| WO | 0220893 | A1 | | 3/2002 |
| WO | 02058528 | A1 | | 8/2002 |
| WO | 2003027377 | A1 | | 4/2003 |
| WO | 03102291 | A1 | | 12/2003 |
| WO | 2006010924 | A1 | | 2/2006 |
| WO | 2006021760 | A1 | | 3/2006 |
| WO | 2006037354 | A1 | | 4/2006 |
| WO | 2006042631 | A1 | | 4/2006 |
| WO | 2006061041 | A1 | | 6/2006 |
| WO | 2006094219 | A1 | | 9/2006 |
| WO | 2006098571 | A1 | | 9/2006 |
| WO | 2007056097 | A2 | | 5/2007 |
| WO | 2008034691 | A1 | | 3/2008 |
| WO | 2008034965 | A1 | | 3/2008 |
| WO | 2008053183 | A1 | | 5/2008 |
| WO | 2008138798 | A2 | | 11/2008 |
| WO | 2008155264 | A1 | | 12/2008 |
| WO | 10010433 | A2 | | 1/2010 |

OTHER PUBLICATIONS

German Search Report for Counterpart DE102009030288, dated Feb. 27, 2012.

German Search Report for Counterpart DE102009030289, dated Feb. 11, 2014.

German Search Report for Counterpart DE102009030329, dated Feb. 7, 2014.

* cited by examiner

HOUSEHOLD CLEANING APPLIANCE WITH A NON-BULK DISPENSING SYSTEM CONVERTIBLE TO A HOUSEHOLD CLEANING APPLIANCE WITH A BULK DISPENSING SYSTEM

CROSS REFERENCE TO RELATED APPLICATIONS

This application is a divisional of U.S. patent application Ser. No. 12/165,726, filed Jul. 1, 2008, which is hereby incorporated by reference in its entirety.

BACKGROUND OF THE INVENTION

Contemporary cleaning appliances, such as dishwashers or clothes washers, may be a common convenience in many homes. A user simply loads the cleaning appliance with laundry to be treated into a treating chamber, along with an optional supply of a treating chemistry, such as detergents, bleach, enzymes, and anti-spotting agents and selects and initiates a cleaning cycle that is subsequently automatically carried out by the cleaning appliance. An example of a typical cleaning cycle includes the washing of the laundry with liquid and optional treating chemistry and rinsing the laundry with liquid.

Cleaning appliances may be provided with a dispenser for automatically dispensing one or more treating chemistries during a cleaning cycle. One common type of dispenser is the manual or single use dispenser, which may be filled with only enough treating chemistry for a single cleaning cycle. A user must fill these manual dispensers with treating chemistry prior to each cleaning cycle of the cleaning appliance, which may be a tedious task that many users would prefer not to perform. In addition, users may not supply the correct dosage of the treating chemistries for the selected cleaning cycle, which may negatively impact the efficacy of the cleaning cycle.

While still relatively uncommon in household cleaning appliances as compared to the single use dispensing systems, bulk dispensing systems for household cleaning appliances may be one solution that improves the ease of supplying treating chemistry in the proper dosage to the cleaning appliance for the user. Bulk dispensing systems contain enough treating chemistry for multiple cycles and control the dispensing of the chemistry on a cycle-by-cycle basis. However, many users are unwilling to purchase a new machine just for a bulk dispensing system.

SUMMARY OF THE INVENTION

An embodiment of the invention relates to a household cleaning appliance comprising a treating chamber and a non-bulk dispensing system coupled with the treating chamber and having a portion of material configured to be removable wherein the non-bulk dispensing system is configured to receive a removable cartridge containing a treating chemistry when such material is removed

DESCRIPTION OF EMBODIMENTS OF THE INVENTION

Figure 1:
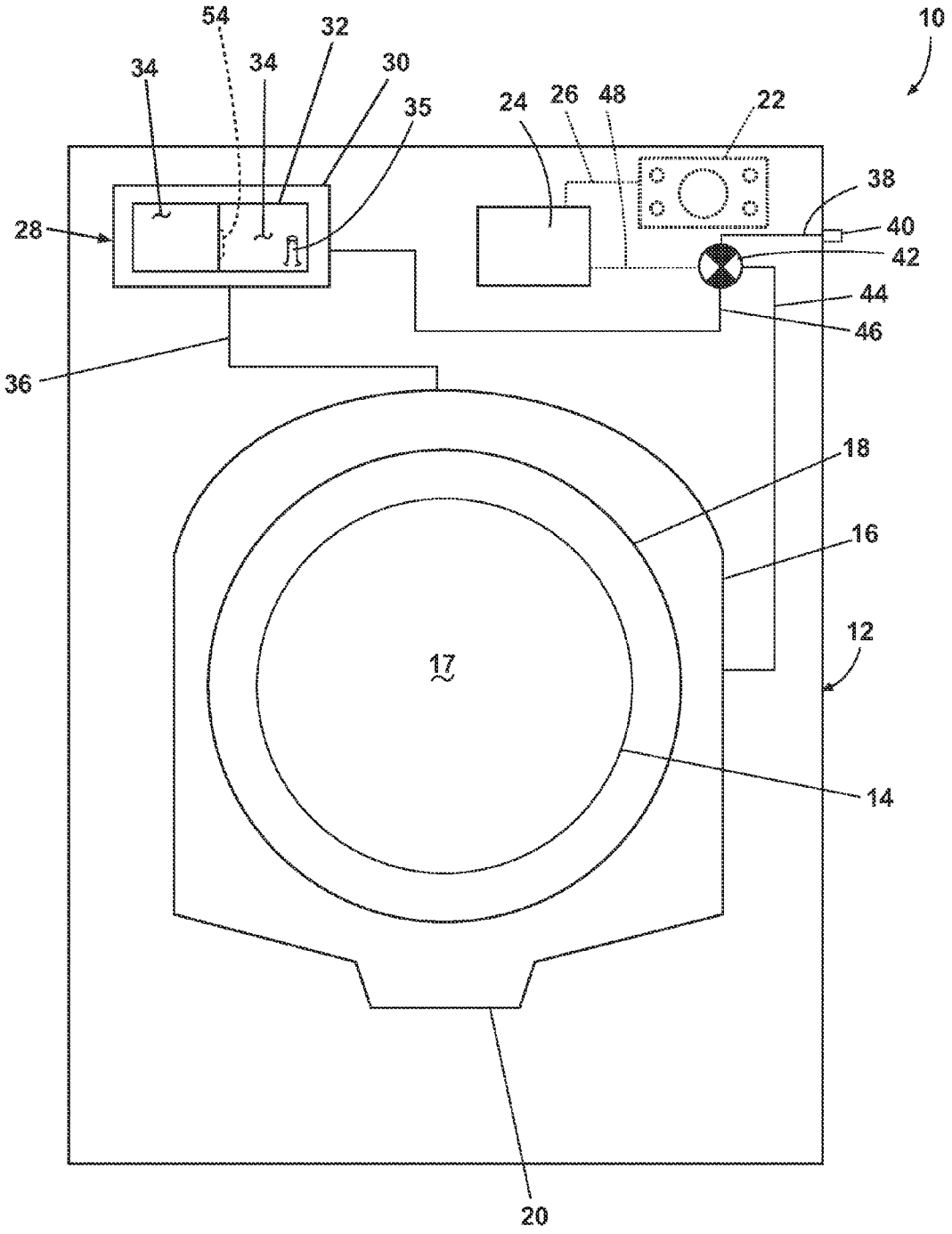
FIG. 1 is a schematic view of an automatic clothes washing machine having a single use dispensing system according to one embodiment of the invention.

Referring now to FIG. 1, a first embodiment of the invention may be illustrated as a cleaning appliance in the environment of a horizontal axis automatic clothes washing machine 10. Although much of the remainder of this application will focus on the embodiment of an automatic clothes washing machine 10, the invention may have utility in other environments, including other cleaning appliances, especially in dishwashers. The automatic clothes washing machine 10 shares many features of a conventional automated clothes washer, which will not be described in detail herein except as necessary for a complete understanding of the invention. The invention may also be utilized in other fabric treatment appliances such as a dryer, such as a tumble dryer or a stationary dryer, or a combination washing machine and dryer.

Further, washing machines may be typically categorized as either a vertical axis washing machine or a horizontal axis washing machine. While there are situations where technology may not be transferable between horizontal axis machines and vertical axis machines, the invention disclosed herein may be suitable for use in both horizontal axis and vertical axis automatic clothes washing machines. As used herein, the "vertical axis" washing machine refers to a washing machine having a rotatable drum that rotates about a generally vertical axis relative to a surface that supports the washing machine. However, the rotational axis need not be vertical. The drum may rotate about an axis inclined relative to the vertical axis. As used herein, the "horizontal axis" washing machine refers to a washing machine having a rotatable drum that rotates about a generally horizontal axis relative to a surface that supports the washing machine. In some horizontal axis washing machines, the drum rotates about a horizontal axis generally parallel to a surface that supports the washing machine. However, the rotational axis need not be horizontal. The drum may rotate about an axis inclined relative to the horizontal axis, with fifteen degrees of inclination being one example of inclination.

Vertical axis and horizontal axis machines are best differentiated by the manner in which they impart mechanical energy to the fabric articles. In vertical axis machines, the fabric moving element moves within a drum to impart mechanical energy directly to the clothes or indirectly through wash liquid in the drum. In horizontal axis machines, mechanical energy is usually imparted to the clothes by the tumbling action formed by the repeated lifting and dropping of the clothes, which may be typically implemented by the rotating drum. The invention disclosed herein may be suitable for use in both horizontal axis and vertical axis automatic clothes washing machines. The invention will be illustrated and described, however, in the context of a horizontal axis washing machine.

The automatic clothes washing machine 10 may include a cabinet 12 enclosing components typically found in a conventional washing machine, such as motors, pumps, fluid lines, controls, sensors, transducers, and the like. A door 14 may be mounted to the cabinet 12 to selectively close an access opening to the interior of liquid-holding, imperforate drum 16 that defines a treating chamber 17 in which laundry may be treated. A perforated basket 18 may be located within the drum 16. The basket 18 may rotate within the drum 16. Both the drum 16 and the basket 18 may be suspended in the interior of the cabinet 12. The drum 16 may be associated with a sump 20 for temporarily storing or collecting a liquid used during a cleaning cycle. The sump may be normally connected to a drain (not shown) to provide a flow path for removing the liquids.

While the drum 16 may be described as defining the treating chamber, with the basket 18 located within the drum, and thereby located within the treating chamber, it may be that just the basket need be considered the treating chamber as the laundry may be typically retained within the basket and the treating chemistry may be directly into the basket or indirectly through the drum.

While not shown, some clothes washers include a recirculation system for recirculation of liquid from the sump to the laundry in the basket 18. The recirculating spray may be used in combination with rotating the drum to draw the sprayed liquid through the laundry using centrifugal force. Alternatively, or in combination with the recirculation system, the liquid may be raised to a level within the drum 16 where a portion of the basket 18 may be submerged. The rotation of the basket 18 causes the laundry to tumble in the liquid. Either of the recirculation or tumble methods of cleaning may be used with the current invention.

A user interface 22 may be provided that has operational controls such as dials, lights, switches, and displays enabling a user to input commands to a controller 24 and receive information about a specific cleaning cycle from sensors in the washing machine 10 or via input by a user through the user interface 22. To aid the input of information by the user, the user interface 22 may be electrically coupled with the controller 24 through user interface leads 26. The user may enter many different types of information, including, without limitation, cycle selection and cycle parameters, such as cycle options. Any suitable cycle may be used. Examples include, Heavy Duty, Normal, Delicates, Rinse and Spin, Sanitize, and Bio-Film Clean Out, to name a few. The term "cleaning cycle" may be used to mean one operational cycle of the automatic clothes washing machine 10 that cleans a load of laundry.

The cabinet 12 may also include a dispensing system 28 for dispensing treating chemistry during a cleaning cycle. In this embodiment, the treating chemistry may be any type of aid for treating fabric, and examples may include, but are not limited to washing aids, such as detergents and oxidizers, including bleaches, and additives, such as fabric softeners, sanitizers, de-wrinklers, and chemicals for imparting desired properties to the fabric, including stain resistance, fragrance (e.g., perfumes), insect repellency, and UV protection.

The dispensing system 28 illustrated in FIG. 1 may include a dispenser housing 30 provided with the cabinet 12 and fluidly coupled to the drum 16. The dispensing system 28 may also include at least one dispensing cup 34. The at least one dispensing cup 34 stores a single dose of treating chemistry that the single use dispensing system 28 may dispense to the drum 16, as part of the execution of the cleaning cycle; i.e., typically the entire volume of chemistry contained within the dispensing cup 34 is dispensed into the drum 16 during a single cleaning cycle. The at least one dispensing cup 34 may include a dispenser siphon or suction pipe (not shown).

The dispensing cup may be provided on an exterior of the cabinet 12 and immediately accessible by the user or hidden behind a cover, such as a drawer or access panel. As illustrated, the at least one dispensing cup 34 may be carried by a dispenser drawer 32 that may be slideably received within the dispenser housing 30 for movement between a fill position, where the at least one dispensing cup 34 may be exterior of the cabinet 12 and a dispense position, where the at least one dispensing cup 34 may be interior of the cabinet 12 and fluidly coupled to the dispenser housing 30.

Further, the dispenser housing 30 may underlie the dispenser drawer 32 when the dispenser drawer 32 sits in the closed position. The dispenser drawer 32 and the at least one dispensing cup 34 may fluidly couple with the dispenser housing 30 such that when the dispenser drawer 32 or the at least one dispensing cup 34 overflows, the overflow goes to the dispenser housing 30. The suction pipes 35 may then lead to the dispenser housing 30 that in turn may be fluidly connected to a dispensing line 36 such that the liquid exiting the suction pipe during flushing may be directed to the drum 16. The single use dispensing system 28 may be illustrated as including multiple dispensing cups 34. The dispensing system 28 with the at least one dispensing cup 34 as described thus far represents a non-bulk dispensing system or a manual dispenser.

A water supply system may also be provided to selectively supply water from a household water supply to the drum 16 and/or the dispensing system 28 as determined by the controller 24. The water supply system may include a conduit 38 fluidly coupling a water supply 40 to a distribution valve 42. The distribution valve 42 may couple the water supply to the drum 16 and dispensing system 34 via dispensing line 44 and a dispensing line 46, respectively. In the embodiment shown, the dispensing line 44 fluidly couples directly to the drum 16, whereas dispensing line 46 fluidly couples to the dispensing system 28. The distribution valve 42 may be electrically coupled to the controller 24 by a valve control lead 48. Thus, the controller 24 may control the valve to control the supply of water directly to the drum 16 and/or the dispensing system 28.

A dispensing line 36 fluidly couples the dispensing system 28 with the drum 16. To dispense the treating chemistry placed in the at least one dispensing cup 34, water may be added to the at least one dispensing cup 34 until the liquid may be above the pipe 35, at which point the liquid may be drawn by gravity into the pipe 35, which initiates a siphon process for removing the liquid from the at least one dispensing cup 34. Water may be added until it may be reasonably certain that substantially all of the treating chemistry may be dispensed from the at least one dispensing cup 34. Thus, fresh water may be delivered from the water supply 40 through the conduit 38, distribution valve 42 and dispensing line 46 into the dispensing system 28 for flushing treating chemistry from the dispensing system 28 through the dispensing line 36 into the drum 16. The controller 24 may control the operation of the distribution valve 42 in response to instructions received from the user interface 22 because of selections made by the user, such as cleaning cycle, water temperature, spin speed, extra rinse, and the like.

Figure 2:
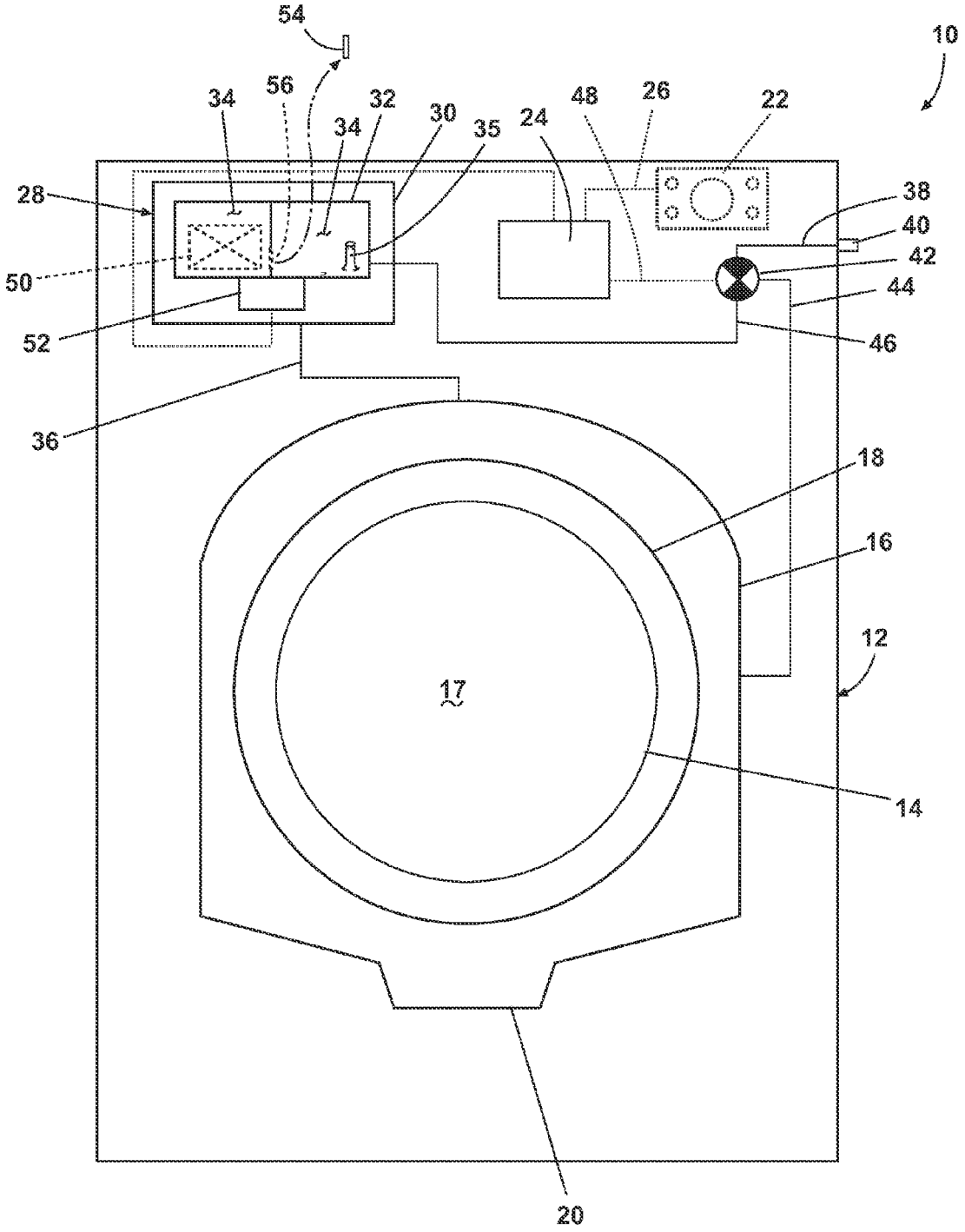
FIG. 2 is a schematic view of the automatic clothes washing machine of FIG. 1 converted to a bulk dispensing system.

FIG. 2 illustrates the automatic clothes washing machine 10 of FIG. 1 converted to a bulk dispensing system according to one embodiment of the invention. A user may convert the dispensing system 28 from a single use dispensing system into a bulk dispensing system by inserting a bulk dispensing cartridge 50 into the at least one dispensing cup 34. The bulk dispensing cartridge 50 may be configured to store multiple doses of a treating chemistry, such as a laundry detergent, stored therein and sufficient for several cleaning cycles.

Although the bulk dispenser cartridge has been illustrated or described as a rectangular box-like container, the bulk dispensing cartridge may be any type of removable container configured to store multiple doses of a treating chemistry. The container may have any shape and size that is receivable within the dispenser. The removable container may be flexible, rigid, expandable, or collapsible. The container may be made of any type of material. Some examples of suitable cartridges are, without limitation, a plastic container, a cardboard container, a coated cardboard container, and a bladder, all of which are capable of being received within the dispenser.

When received within a dispensing cup 34, the bulk dispensing cartridge 50 may fluidly couple with the at least one dispensing cup 34, or may fluidly couple with another of the dispensing cups 34, or may fluidly couple with the dispenser housing 30 to establish a dispensing flow path for the treating chemistry in the bulk dispensing cartridge. The fluid flow path may be established by forming one or more openings in the dispenser housing 30 which may be in fluid communication with the at least one dispensing cup 34. The openings may be formed by drilling or puncturing the dispenser housing 30. The openings are illustrated as being formed by removing at least one punch-out 54 in the dispenser housing 30. This can potentially be performed by a consumer or it may be done during the manufacturing stage of the washing machine 10. It should be noted that the punch-outs herein described are designed and located in a manner that will allow the user to revert back to a single use dispensing system without leaks even after the punch-out has been removed and an opening has been formed.

The bulk dispensing cartridge 50 may potentially be received in any of the at least one dispensing cups 34. In most cases, the dispensing cups 34 have a volume greater than a single dose of treating chemistry. The cartridge may be sized to take up the entire volume of the dispensing cup 34 to provide for as many doses of treating chemistry as possible.

In some embodiments of the invention, it is contemplated that the bulk dispensing cartridge 50 may include an integrated metering device that electronically couples, wired or wirelessly, to the controller to control the amount of treating chemistry dispensed. As illustrated, however, the bulk dispensing cartridge 50 includes a physically separate treating chemistry meter 52, which may be added to the single use dispensing system and fluidly couples the bulk dispensing cartridge 50 to the dispenser housing 30 to establish a metered bulk dispensing flow path from the bulk dispensing cartridge 50 to the dispenser housing 30. The treating chemistry meter 52 may allow for a fractional amount of the entire volume of the cartridge to be dispensed. It may also allow for a specific volume to be dispensed.

The treating chemistry meter 52 may operably couple to the bulk dispensing cartridge 50 to control the dosing of the treating chemistry from the bulk dispensing cartridge 50 to the dispensing system 28 or to a conduit formed by the dispenser housing 30 and the dispensing line 36 that in turn fluidly couples to the drum 16. The treating chemistry meter 52 may be a pump fluidly coupling the bulk dispensing cartridge 50 to the dispensing system 28. More specifically the bulk dispensing cartridge 50 may be fluidly coupled to the dispenser housing 30, the dispenser drawer 32, or another dispensing cup 34 through the treating chemistry meter 52 when the dispenser drawer 32 is in the closed position. The treating chemistry meter 52 may be operably coupled with the controller 24 such that the controller 24 may implement the cleaning cycle by controlling the operation of the treating chemistry meter 52 to thereby control the dosing of the treating chemistry from the bulk dispensing cartridge 50 to the dispensing system 28.

In one embodiment of the invention, the treating chemistry meter 52 may dose treating chemistry into the drum 16 multiple times during a single cleaning cycle. Dosing of the treating chemistry does not need to be done all at one time. For example, smaller amounts of treating chemistry, in total equal to a full single dose, may be dispensed by the treating chemistry meter 52 at separate times throughout the cleaning cycle. Further, multiple full doses may be dispensed during the cleaning cycle. As used herein, the term "single dose of treating chemistry", and variations thereof, refers to an amount of treating chemistry sufficient for one cleaning cycle of the automatic clothes washing machine 10 and the term "multiple doses of treating chemistry", and variations thereof, refers to an amount of treating chemistry sufficient for multiple cleaning cycles of the automatic clothes washing machine.

Figure 3:
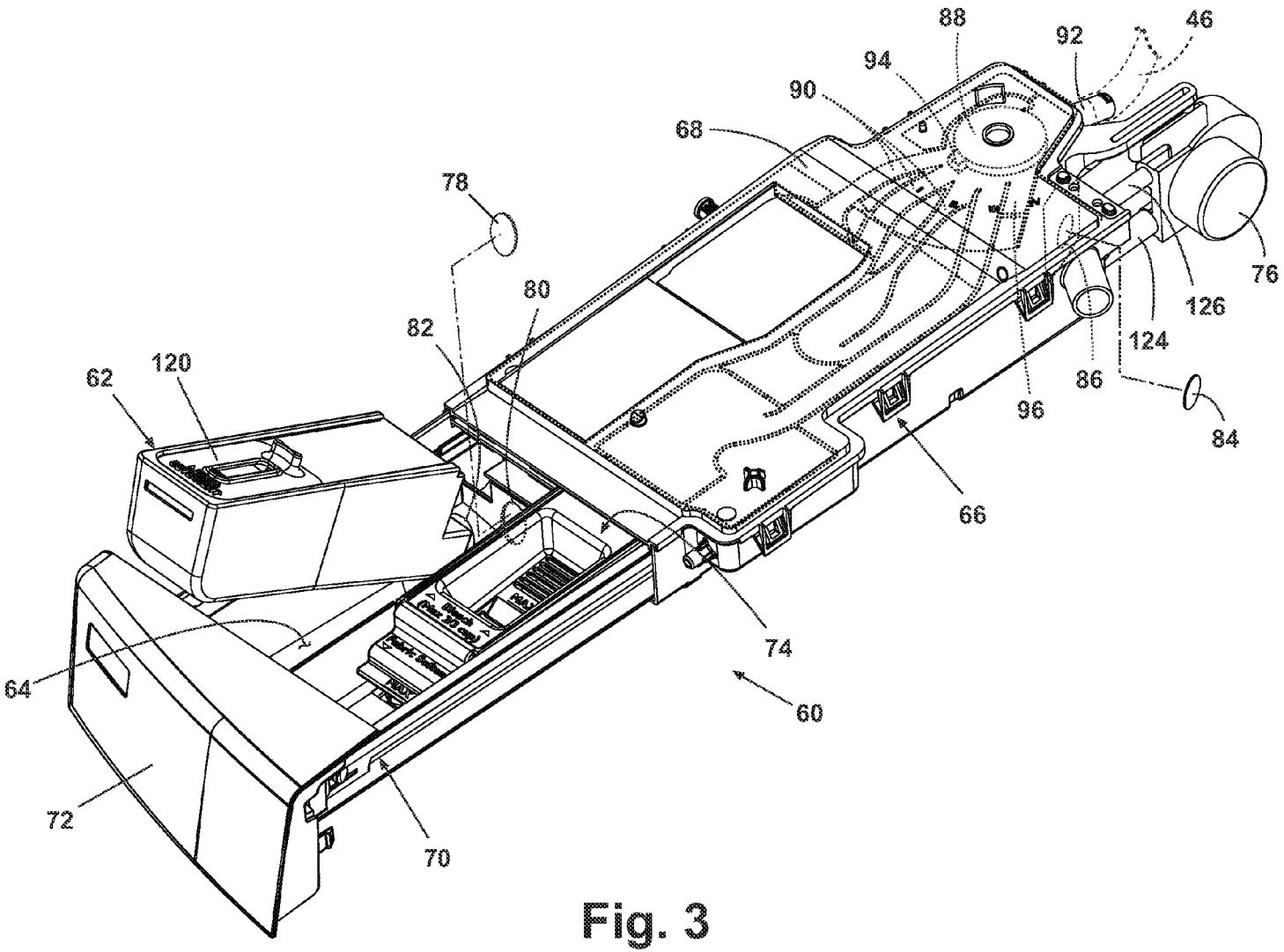
FIG. 3 is a perspective view of an exemplary dispensing system with a bulk dispensing cartridge partially received within a dispensing cup according to one embodiment of the invention.

FIG. 3 illustrates a specific implementation of an exemplary drawer-type, single-use dispensing system 60 according to one embodiment of the invention, which may be converted into a bulk dispensing system by receiving a bulk dispensing cartridge 62 within a dispensing cup 64. The dispensing system 60 includes a dispensing drawer 70 that defines the dispensing cup 64. A handle 72 may be provided on the drawer to aid in the opening and closing of the drawer 70. A lower dispensing housing 66 underlies the drawer and captures water flushed through the dispensing drawer 70 as part of the dispensing process. An upper dispensing housing 68 overlies the drawer 70 and the lower dispensing housing 66 and supplies water to the dispensing drawer 70 and/or the lower dispensing housing 66 to flush the treating chemistry into the drum 16 and/or treating chamber 17. A treating chemistry meter in the form of a dispenser pump 76 may be carried by the lower dispenser housing 66 and establishes fluid communication between the bulk dispensing cartridge 62 and the lower dispenser housing 66 when the drawer is closed to establish a dispensing flow path from the bulk dispensing cartridge 62.

Alternately, the treating chemistry meter could be a mechanical flow meter, a magnetic flow meter, or any other meter suitable for measuring liquid flow, all well known in the cleaning appliance art. Additionally, the treating chemistry could be metered by a gravity drain, or be metered under pressure by a venturi. Furthermore, the treating chemistry could be housed in pressurized cartridges that would also deliver the treating chemistry under pressure.

For the specific implementation of FIG. 3, multiple actions may be taken to convert the single use dispensing system 60 into a bulk dispensing system, in addition to insertion of the bulk dispensing cartridge 62 into the dispensing cup 64. For example, such an action may include removing at least one drawer punch-out 78. If the dispensing drawer 70 currently installed does not have punch outs as shown, the conversion may include forming the openings by any suitable technique, such a punching or drilling, or it may include replacing the drawer 70 or an appropriate component in the drawer with one that has punch outs. By removing the at least one drawer punch-out 78 a drawer opening 80 may be formed in the dispenser drawer 70 through which the bulk dispensing cartridge fluid outlet 82 will extend when the bulk dispensing cartridge 62 is fully received within the at least one dispensing cup 64. If the dispensing drawer 70 currently installed does not have punch outs as shown, the conversion may include forming the openings by any suitable technique, such a punching or drilling, or it may include replacing the drawer 70 with one that has punch outs.

The bulk dispensing cartridge 62 may be removeably received in the dispensing cup 64. The bulk dispensing cartridge 62 may store multiple doses of treating chemistry because the treating chemistry it stores may be of a higher concentration than normally required for a single use dispensing cup 64 and/or it may be of larger volume than the portion of the dispensing cup 64 used to hold treating chemistry.

When the bulk dispensing cartridge 62 is received within the dispensing cup 64, the bulk dispensing cartridge 62 fluidly couples with the dispensing system 60 and makes it a bulk dispensing system. The use of the bulk dispensing cartridge 62 eliminates the need for a user to measure out a selected volume of treating chemistry for each cleaning cycle. The bulk dispensing cartridge 62 is illustrated as a generally rectilinear, box-like container defining a cartridge cavity or an interior treating chemistry chamber in which the treating chemistry may be contained. However, it may have any suitable shape. The interior treating chemistry chamber of the cartridge 62 may be accessible through an opening selectively closed by a closing element 120 operable between an opened and closed position through which the bulk dispensing cartridge 62 may be filled when the closing element 120 is in the opened position. In other embodiments of the invention the cartridge 62 may not be refillable.

Figure 4:
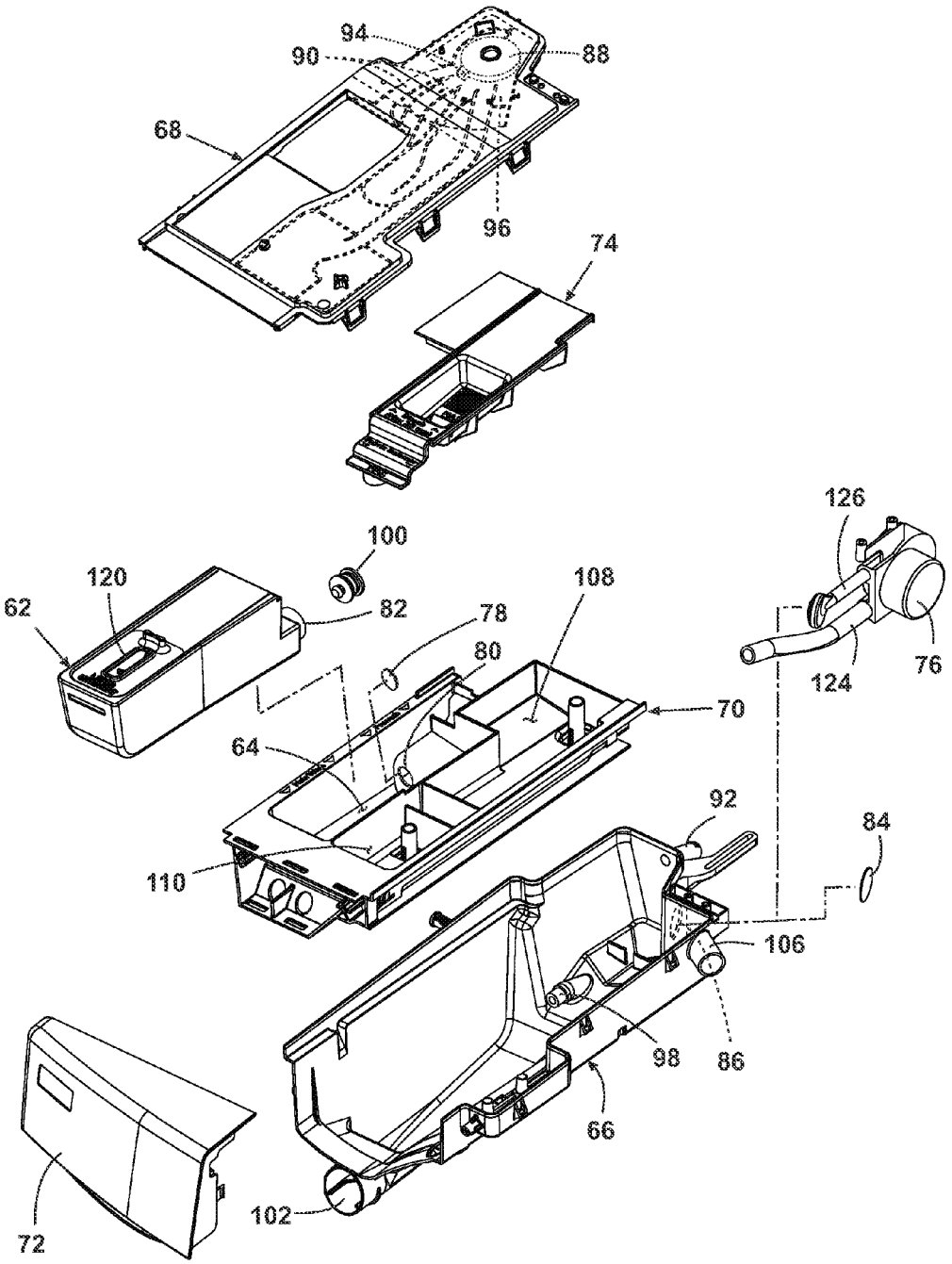
FIG. 4 is an exploded view of the bulk dispensing system illustrated in FIG. 3.

As shown in FIG. 4, the dispenser drawer 70 may be illustrated as including multiple dispensing cups 64, 108, 110 that act as treating chemistry reservoirs or compartments that may hold treating chemistry, such as laundry detergent, fabric softener, bleach, and the like. It should be noted that while the bulk dispensing cartridge 62 may be configured to fit in any of the dispensing cups 64, 108, and 110, the bulk dispensing cartridge 62 may be sized to fit in the largest of the chambers to maximize the holding capacity of the bulk dispensing cartridge. In most single use dispensing systems, the detergent cup will be the largest cup because most detergent cups are sized to receive both liquid and powder detergents, with powder detergents requiring a larger volume for the same dosing. Typically, a moveable/removable dividing wall (not shown) may be placed in the detergent chamber and may be moved/removed within/from the chamber to select from liquid or powder detergents. This wall may be removed to make the entire volume of the chamber usable by the bulk dispensing cartridge 62. It should be noted that, when a bulk dispensing cartridge has been inserted into one of the dispensing cups 64, 108, and 110, the other dispensing cups not holding the bulk dispensing cartridge may be used in their normal single use dispenser fashion. For example, the bulk dispensing cartridge 62 may contain detergent for dispensing in multiple cycles, while the other cups contain a single use of bleach or fabric softener, which would be dispensed in the current cycle.

The dispenser drawer 70 may be slideably moveable between a fill position, where the at least one dispensing cup is accessible exteriorly of the cabinet 12, and a dispense position, where the at least one dispensing cup is within the cabinet 12. The dispenser drawer 70 may be fluidly coupled to the lower dispenser housing 66 such that when the dispenser drawer 70 overflows, the overflow goes to the lower dispenser housing 66. The dispenser drawer handle 72 may be used to effect the movement of the dispenser drawer 70. The cup cover 74 when inserted into the dispenser drawer 70 typically overlies a portion of the dispenser drawer 70 and more specifically overlies at least a portion of dispensing cups 108, 110.

In some embodiments of the invention, the pump 76 may be mounted to the dispenser housing 30. Before mounting the dispenser pump 76 a punch-out 84 may be removed from the lower dispenser housing 66 creating a lower dispenser housing second port 86 (shown in phantom). Then, the dispenser pump 76 may be installed such that when the dispenser drawer 70 may be in the closed position, the bulk dispensing cartridge 62 fluidly couples to the lower dispenser housing 66 through the dispenser pump 76 and through the lower dispenser housing second port 86. Thus, when the dispenser drawer 70 may be in the closed position, the dispenser pump 76 may draw treating chemistry from the bulk dispensing cartridge 62 and dispense it to the lower dispenser housing 66 thereby creating a metered bulk dispensing flow path to the lower dispenser housing 66.

The dispenser pump 76 may be operably coupled to the controller 24 and to the bulk dispensing cartridge 62 such that the controller 24 operates to control dosing of the treating chemistry from the bulk dispensing cartridge 62 to the lower dispenser housing 66 and the dispensing line 36, which in turn fluidly couples to the drum 16. The dispenser pump 76 may have a motor and the motor may be operably coupled to the controller 24 such that the controller 24 controls the actuation of the motor and thus controls the dosing of the treating chemistry from the bulk dispensing cartridge 62 to the lower dispenser housing 66.

The water supply 40 may be fluidly coupled to either of the dispenser drawer 70 or the lower dispenser housing 66 via the upper dispenser housing 68, a water diverter 88, the conduit 38, and the distribution valve 42 that may be operably controlled by the controller 24. Although in the embodiment shown, water is capable of being routed through the upper dispenser housing 68 to the lower dispenser housing 66 this may not always be the case in other automatic clothes washing machine designs. If in its original single use dispensing configuration the upper dispensing housing 68 is not capable of dispensing water to the lower dispenser housing, the upper dispensing housing 68 may be replaced with one that may.

The upper dispenser housing 68 may be formed such that water paths 90 may be located in its interior. Water from the water supply 40 may be fluidly coupled through dispensing line 46 with a port 92, shown here in the lower dispenser housing 66 although it could be located elsewhere in other embodiments of the invention. Port 92 illustrates the primary water inlet to the dispensing system from the water supply 40. The water diverter 88, and thus the water diverter outlet 94, may be operably coupled with the controller 24. The water diverter 88 may selectively control the fluid coupling of the water diverter outlet 94 with each of the different water paths 90. Port 92 may be coupled with the water diverter 88 so that water from the port 92 may enter the water diverter 88 and may be directed through a water diverter outlet 94 into one of the different water paths 90 to various portions of the lower dispenser housing 66 or to various portions of the dispenser drawer 70.

Once the conversion described above has taken place, including the insertion of the bulk dispensing cartridge 62, the converted system may be operated as a bulk dispensing system. Typically, this may be accomplished by a user selecting a cleaning cycle on the user interface 22, which would then be processed by the controller 24, typically along with a determination in a known manner of the size of the load, to automatically dispense the appropriate volume of treating chemistry by ways known to those skilled in the art. Alternatively, the user could input appropriate load conditions, e.g., size and fabric type, or directly select a desired volume, e.g., 30 ml, or "small", "medium", or "large" amounts, of treating chemistry on the user interface 22. During operation of the automatic clothes washing machine 10, when the time comes to dispense the treating chemistry, the controller 24 signals the dispenser pump 76 to supply a treating chemistry from the bulk dispensing cartridge 62 to the lower dispenser housing 66.

Referring to FIG. 2, the water diverter 88, operated by the controller 24, may divert a flow of water through one of the different water paths 90 to the lower dispenser housing 66. This water flow path, labeled as 96, establishes a water supply to the lower dispenser housing 66 that, in the embodiment shown, totally bypasses the dispenser drawer 70. The controller 24 may signal the distribution valve 42 to flow water from the water supply 40 into port 92 of the lower dispenser housing 66 wherein the water may be directed through water path 96 downwards towards the treating chemistry located in the lower dispenser housing 66. When water is supplied to the lower dispenser housing 66, it may flow over a treating chemistry dispensed into the lower dispenser housing 66 through the metered bulk dispensing flow path. Thus, the water path 96 may direct water from the supply to the lower dispenser housing 66 to flush a treating chemistry to the treating chamber through the dispensing line 36. In this way, the lower dispenser housing 66 and the dispensing line 36 may be described as forming a conduit to the treating chamber.

Essentially, the automatic washing machine 10 effects a flushing of both the lower dispenser housing 66 and the conduit formed by the lower dispenser housing 66 and the dispensing line 36. The flushing of the lower dispenser housing 66 or conduit may also act to at least partially flush the dispenser pump 76, which fluidly couples with the conduit. The controller 24 may also introduce water from the water supply 40 into the dispenser drawer 70. This may act to flush both the dispenser drawer 70 and at least a portion of the lower dispenser housing 66 or conduit as they may be fluidly coupled. Then, both the water and the treating chemistry travel down the lower dispenser housing 66, through the outlet port 102 (FIG. 4), through the dispensing line 36, and into the drum 16. After exiting the lower dispenser housing 66 through the outlet port 102 the treating chemistry may also go through any accompanying sprayers or conduits on its way to the drum 16.

FIG. 4 provides more detail to the conversion of the dispenser and the operation of the dispenser once converted. For example, it may more easily be seen in FIG. 4 that once the at least one drawer punch-out 78 is removed the bulk dispensing cartridge fluid outlet 82 may extend through opening 80 and couple with port 98. A coupler 100 may fit within the bulk dispensing cartridge fluid outlet 82 and when the dispenser drawer 70 lies in the dispense position, the port 98 may engage the coupler 100 wherein the coupler 100 then fluidly couples the port 98 with the dispenser pump 76. While the coupler 100 has been illustrated as a separate insert into the bulk dispensing cartridge 62 the coupler may also be attached to the dispenser pump inlet 124 or may be an integrated portion of the lower dispenser housing 66 or an integrated portion of the dispenser pump 76. A dispenser pump inlet 124 fluidly couples with the bulk dispensing cartridge 62 through the port 98 in the lower dispenser housing 66.

Further, it may more easily be seen in FIG. 4 that the punch-out 84 may be removed to form a lower dispenser housing second port 86 through which the dispenser pump 76 may fluidly couple with the lower dispenser housing 66. A dispenser pump outlet 126 may fluidly couple through the lower dispenser housing second port 86 to the lower dispenser housing 66 such that when treating chemistry may be metered through the dispenser pump 76, it may be deposited within the lower dispenser housing 66. From the lower dispenser housing 66 any treating chemistry and water dispensed to the lower dispenser housing 66 may flow to the dispensing line 36 through an outlet port 102.

Figure 5:
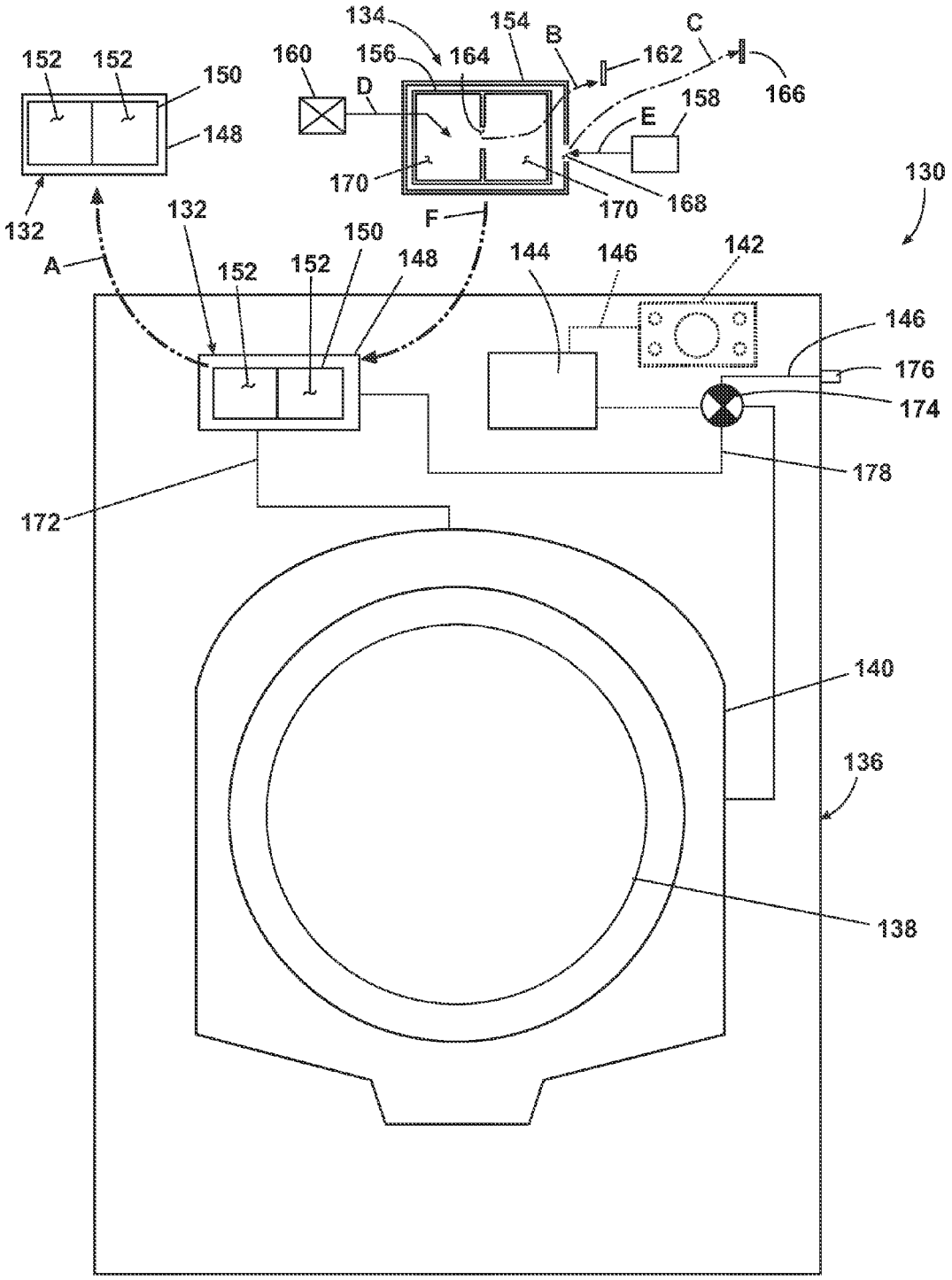
FIG. 5 is a schematic view of another embodiment of converting an automatic clothes washing machine having a single use dispensing system to a bulk dispensing system.

FIG. 5 illustrates another embodiment of converting an automatic clothes washing machine 130 having a single use dispensing system 132 to an automatic clothes washing machine 130 having a bulk dispensing system 134. The automatic clothes washing machine 130 may include a cabinet 136. A door 138 may be mounted to the cabinet 136 to selectively close an access opening to the interior of a known treating chamber 140 in which laundry may be treated. The cabinet 136 may include a user interface 142 that has operational controls such as dials, lights, switches, and displays enabling a user to input commands to a controller 144 and receive information about a specific cleaning cycle. The user interface 142 may be electrically coupled with the controller 144 through user interface leads 146.

The cabinet 136 may also include a single use dispensing system 132 for dispensing treating chemistry during a cleaning cycle. The single use dispensing system 132 shown includes a dispenser housing 148, and a dispenser drawer 150 defining at least one dispensing cup 152 configured to receive a single dose of treating chemistry that the single use dispensing system 132 dispenses to the treating chamber 140, as part of the execution of the cleaning cycle.

FIG. 5 illustrates the conversion of the automatic clothes washing machine 130 having a single use dispensing system 132 to an automatic clothes washing machine 130 with a bulk dispensing system 134 through several actions A-F. The user may obtain a kit that includes a new dispenser housing 154, a new dispenser drawer 156, a dispenser pump 158 and a bulk dispensing cartridge 160. The user may then retrofit the automatic clothes washing machine 130 having a single use dispensing system 132 into an automatic clothes washing machine 130 having a bulk dispensing system 134.

First, the user may remove the single use dispensing system 132 illustrated with an arrow as action A. The new dispenser drawer punch-out 162 may be removed in action B forming a drawer opening 164 in the new dispenser drawer 156. The new dispenser housing punch-out 166 may be removed in action C forming a housing opening 168 in the new dispenser housing 154. In action D, the bulk dispensing cartridge 160 may be inserted into the dispensing cup 170. The new dispenser drawer 156 includes a fluid conduit that fluidly couples the bulk dispensing cartridge 160 to the dispenser pump 158 through the drawer opening 164. The drawer opening 164 may receive the bulk dispensing cartridge fluid outlet when the bulk dispensing cartridge 160 is inserted into the new dispenser drawer 156.

In action E, the dispenser pump 158 may be mounted to the new dispenser housing 154, fluidly coupling with the new dispenser drawer 156 through the housing opening 168 (created in action C). In action F, the user replaces the dispenser drawer 150 with a new dispenser drawer 156 having at least one dispensing cup 170 (and having the bulk dispensing cartridge 160 inserted in action D). The user also replaces the dispenser housing 148 with a new dispenser housing 154 (having the dispenser pump 158 mounted to it as in action E) fluidly coupled to a treating chamber 140 in the cabinet 136. The new dispenser housing 154 comprises a fluid conduit that fluidly couples with the bulk dispensing cartridge fluid outlet, through the new dispenser drawer 156, when the bulk dispensing cartridge 160 may be received in the at least one dispensing cup 170, to the dispenser pump fluid inlet, through the new dispenser drawer 156, when the new dispenser drawer 156 may be in a dispensing position interior of the cabinet 136 and comprises a fluid conduit that fluidly couples the dispenser pump fluid outlet with the treating chamber 140 through the dispensing line 172.

After proper installation of the bulk dispensing cartridge 160 in the dispensing cup 170 the bulk dispensing system 134 may be employed to dispense the treating chemistries contained therein into the treating chamber 140 under the control of the controller 144. When the time comes to dispense the treating chemistry, the controller 144 signals the dispenser pump 158 to supply a treating chemistry from the bulk dispensing cartridge 160 to the new dispenser housing 154 through the new dispenser drawer 156. The controller 144 then signals a valve 174 to allow water from a water supply 176 through a dispensing line 178 and into the new dispenser housing 154 to effect a flushing. The flushing of the new dispenser housing 154 may also act to flush the dispenser pump 158, which fluidly couples with the new dispenser housing 154. Then, both the water and the treating chemistry travel through the dispensing line 172, and into the treating chamber 140.

Several of the actions A-F may be reordered as the user desires. For example, actions B and C, the removal of the punch-outs 162 and 166 respectively, may be under taken by the user before action A, the removal of the single use dispensing system 132 from the automatic clothes washing machine 130. Further, additional punch-outs or ports could be located in either the new dispenser drawer 156 or the new dispenser housing 154. For example, an additional punch-out could be located in the new dispenser drawer 156 to create an additional fluid coupling with the new dispenser housing 154. Although FIG. 5 illustrates the conversion of a single use dispensing system to a bulk dispensing system by inserting both a new dispenser drawer 156 and a new dispenser housing 154 the conversion could alternately occur with the replacement of either a new dispenser drawer 156 or a new dispenser housing 154.

Figure 6:
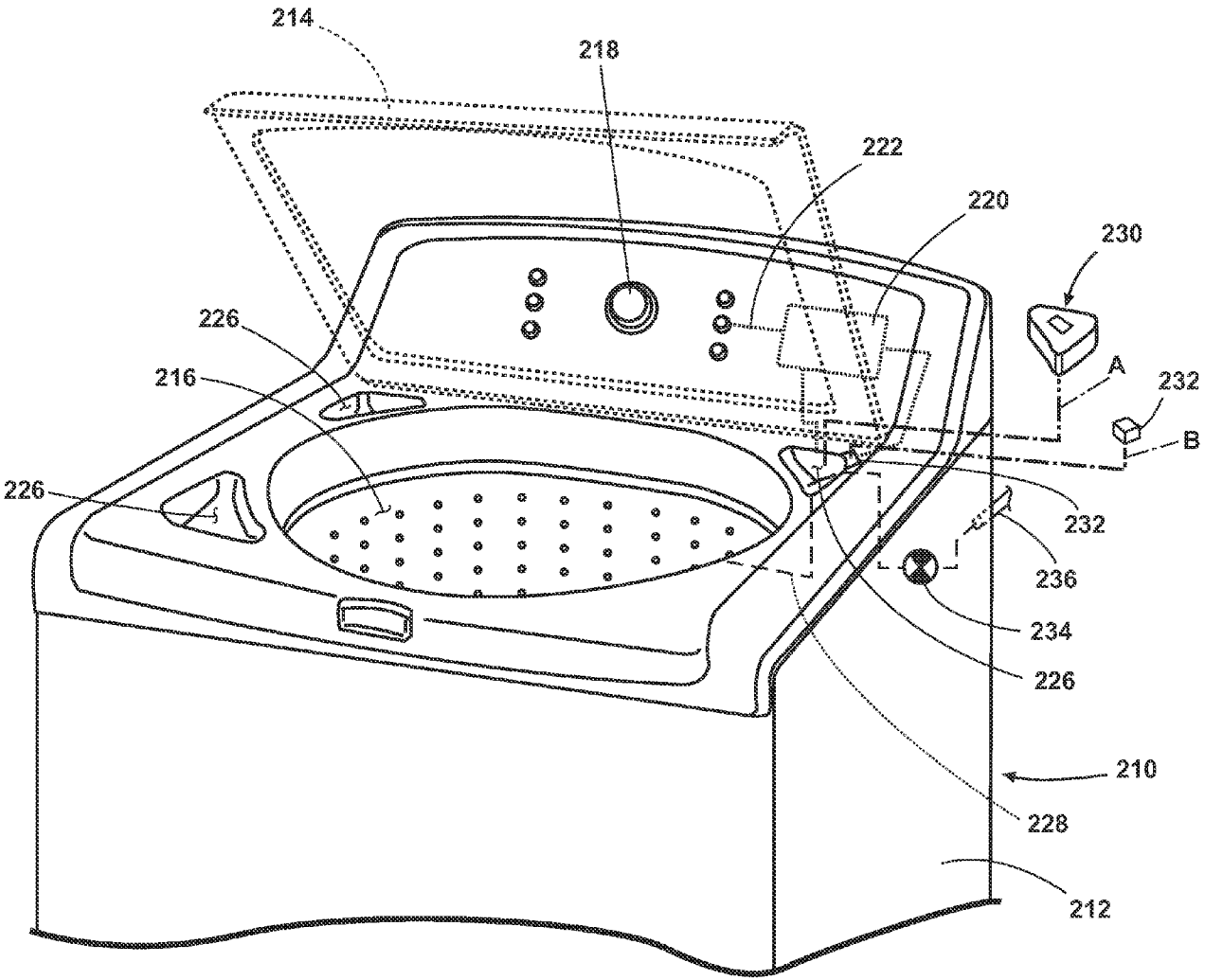
FIG. 6 is a schematic view of another embodiment of converting an automatic clothes washing machine having a single use dispensing system to a bulk dispensing system.

FIG. 6 illustrates yet another embodiment for converting an automatic clothes washing machine, this time in the environment of a vertical axis automatic clothes washing machine 210. The automatic clothes washing machine 210 may include a cabinet 212 enclosing components typically found in a conventional washing machine, such as motors, pumps, fluid lines, controls, sensors, transducers, and the like. A door 214 (shown in phantom) may be mounted to the cabinet 212 to selectively close an access opening to the interior of a known treating chamber 216 in which laundry may be treated. The cabinet 212 may include a user interface 218 that may have operational controls such as dials, lights, switches, and displays enabling a user to input commands to a controller 220 and receive information about a specific cleaning cycle. The user interface 218 may be electrically coupled with the controller 220 through user interface leads 222.

A dispensing system for dispensing treating chemistry during a cleaning cycle is illustrated in FIG. 6 as a single use dispensing system having at least one dispensing cup 226 configured to receive a single dose of treating chemistry that the dispensing system may dispense to the treating chamber 216, as part of the execution of the cleaning cycle. While FIG. 6 illustrates multiple dispensing cups 226 physically spaced from one another in the cabinet 212, the single use dispensing system may have any number of dispensing cups 226. Only one of the cups 226 will be described in detail with it being understood that the description applies to all of the dispensing cups 226.

The dispensing cup 226 may include a dispenser siphon pipe, which in FIG. 6 is hidden from view under the top of the cabinet 212. To dispense the treating chemistry placed in the dispensing cup 226, water may be added to the dispensing cup 226 until the liquid may be above the pipe, at which point the liquid may be drawn by gravity into the pipe, which initiates a siphon process for removing the liquid from the dispensing cup 226. Water may be added until it may be reasonably certain that substantially all of the treating chemistry may be dispensed from the dispensing cup 226. While not shown in FIG. 6, the suction pipes may lead to a housing that may be fluidly connected to the dispensing line 228 such that the liquid exiting the suction pipe during flushing may be directed to the treating chamber 216.

FIG. 6 also illustrates the conversion of the automatic clothes washing machine 210 having a single use dispensing system, the at least one dispensing cup 226, to an automatic clothes washing machine 210 with a bulk dispensing system through several actions A-B. The user may obtain a kit that includes a bulk dispensing cartridge 230, and a metering device illustrated as a dispenser pump 232. The user may then retrofit the automatic clothes washing machine 210 having a single use dispensing system into an automatic clothes washing machine 210 having a bulk dispensing system through the series of actions.

First, the user may insert the bulk dispensing cartridge 230 into the dispensing cup 226 in action A to provide the single use dispensing cup 226 with multiple doses of treating chemistry. If the dispensing cup 226 includes a dispenser siphon pipe the dispenser siphon pipe may have to be removed by the user before the bulk dispensing cartridge 230 may be inserted as illustrated in action A. The need to remove the siphon pipe will vary depending on the machine being converted. In most cases, it is anticipated that the siphon pipe will not need to be removed. The bulk dispensing cartridge 230 may be fluidly coupled to the dispensing cup 226 to deliver or dispense treating chemistry to the treating chamber 216 through the dispensing cup 226.

In action B, the dispenser pump 232 may be mounted into the cabinet 212 such that it operably couples to the bulk dispensing cartridge 230 when the bulk dispensing cartridge 230 is received within the dispensing cup 226 to control the dosing of the treating chemistry from the bulk dispensing cartridge 230 to the treating chamber 216. The dispenser pump 232 may be operably coupled with the controller 220 such that the controller 220 may implement the cleaning cycle by controlling the operation of the treating chemistry meter 232 to control the dosing of the treating chemistry from the bulk dispensing cartridge 230 to the treating chamber 216.

After proper installation of the bulk dispensing cartridge 230 in the dispensing cup 226 the bulk dispensing system may be employed to dispense the treating chemistries contained therein into the treating chamber 216 under the control of the controller 220. When the time comes to dispense the treating chemistry, the controller 220 signals the treating chemistry meter 232 to supply a treating chemistry from the bulk dispensing cartridge 230 to the dispensing cup 226. The controller 220 then signals a valve 234 to allow water from a water supply 236 into the dispensing cup 226 to effect a flushing. The flushing of the dispensing cup 226 may also act to flush the treating chemistry meter 232, which fluidly couples with the dispensing cup 226. Then, both the water and the treating chemistry travel through the suction pipe and the dispensing line 228, and into the treating chamber 216.

Alternatively, action A and action B may be reordered such that metering device is installed in the cabinet 212 before the bulk dispensing cartridge 230 is installed in the dispensing cup 226. Alternatively, the dispensing cup 226 and underlying housing (not shown) may be removed from the cabinet 212 and a bulk dispensing system, including a dispenser pump and bulk dispensing cartridge may be inserted in its place. It should be noted that any of the single dose dispensing cups 226 may have bulk dispensing functionality added to it as the bulk dispensing cartridge 230 may be configured to fit in any of the dispensing cups 226. Alternatively, a treating chemistry meter 232 may already be in place in the cabinet 212 such that a user must only insert the bulk dispensing cartridge to convert the single use dispensing system to a bulk dispensing system. For that matter, a treating chemistry meter may be an integral part of the bulk dispensing cartridge 230.

While the invention has been specifically described in connection with certain specific embodiments thereof, it is to be understood that this is by way of illustration and not of limitation, and the scope of the appended claims should be construed as broadly as the prior art will permit.

What is claimed is:

1. A household cleaning appliance, comprising:

a treating chamber; and a non-bulk dispensing system including a set of walls forming at least one dispensing cup fluidly coupled with the treating chamber and wherein a portion of one of the set of walls is configured to be removed to create an opening in the one of the set of walls and wherein the non-bulk dispensing system is configured to receive a removable cartridge containing a treating chemistry that is fluidly coupled to the treating chamber via the opening when the portion is removed and the removable cartridge is received in the non-bulk dispensing system.

2. The household cleaning appliance according to claim 1 wherein when the removable cartridge is received the household cleaning appliance comprises a bulk dispensing system configured to deliver a charge of treating chemistry from the removable cartridge to the treating chamber.

3. The household cleaning appliance according to claim 1 wherein the non-bulk dispensing system comprises a drawer including the set of walls and the portion and wherein the drawer is slidable between an opened position wherein the at least one dispensing cup is accessible by a user and a closed position wherein the drawer is fluidly coupled with the treating chamber.

4. The household cleaning appliance according to claim 3, further comprising a drawer housing fluidly coupling the drawer and the treating chamber and wherein the drawer overlies the dispenser housing in the closed position.

5. The household cleaning appliance according to claim 3, further comprising a metering device coupled to the drawer and operably coupled to the removable cartridge to dispense treating chemistry when the removable cartridge is received within the drawer.

6. The household cleaning appliance according to claim 5, further comprising a water supply to the dispenser housing that bypasses the at least one dispensing cup.

7. The household cleaning appliance according to claim 5, wherein the at least one dispensing cup further comprises a dispenser siphon configured to remove liquid from the at least one dispensing cup.

8. The household cleaning appliance according to claim 5, wherein at least a portion of removable cartridge, the metering device, or a fluid coupler there between extends through the opening.

9. The household cleaning appliance according to claim 8 wherein the metering device comprises a pump.

10. The household cleaning appliance according to claim 8 wherein the metering device comprises a venturi.

11. The household cleaning appliance according to claim 8 wherein the metering device comprises a pressurized cartridge.

12. The household cleaning appliance according to claim 8 wherein the metering device comprises a gravity drain.

13. The household cleaning appliance according to claim 8 wherein the metering device comprises a flowmeter.

14. The household cleaning appliance according to claim 8 wherein the metering device comprises a pumping air into the cartridge.

15. The household cleaning appliance according to claim 5, further comprising a fluid coupler fluidly coupling an outlet of the removable cartridge and an inlet of the metering device.

16. The household cleaning appliance according to claim 1 wherein the portion of material configured to be removable is a punch-out.

17. A household cleaning appliance, comprising:

a cabinet defining an interior;

a treating chamber located within the interior; and a non-bulk dispensing system including a drawer having at least one dispensing cup and where the drawer is slidably mounted to the cabinet wherein the drawer is slidable between an opened position wherein the at least one dispensing cup is accessible by a user and a closed position wherein the drawer overlies a dispenser housing that is fluidly coupled with the treating chamber and wherein the at least one dispensing cup includes a removable portion of material that when removed creates a drawer opening through which a fluid outlet of a removable bulk dispensing cartridge, containing a treating chemistry, extends when the bulk dispensing cartridge is fully received within the at least one dispensing cup such that the fluid outlet of the removable bulk dispensing cartridge is fluidly coupled with the dispenser housing.

18. The household cleaning appliance according to claim 17 wherein the removable portion of material is a punch-out.

19. A household cleaning appliance, comprising:

a treating chamber; and a non-bulk dispensing system including at least one dispensing cup fluidly coupled with the treating chamber and wherein the at least one dispensing cup includes a removable portion of material configured to form an opening in the at least one dispensing cup upon removal and wherein the non-bulk dispensing system is configured to receive a removable cartridge containing a treating chemistry when such material is removed and fluidly couple the removable cartridge to the treating chamber via the opening when the removable cartridge is received in the non-bulk dispensing system and wherein the at least one dispensing cup with the opening is further configured to be utilized as a non-bulk dispensing system.

* * * * *